US006479798B2

(12) United States Patent
Leipold

(10) Patent No.: US 6,479,798 B2
(45) Date of Patent: Nov. 12, 2002

(54) DEVICE AND PROCEDURE OF FORMING A POINT ON WIRE ENDS

(75) Inventor: Josef Leipold, Schwabach (DE)

(73) Assignee: Masohinenfabrik Niehoff GmbH & Co. KG, Schwabach (DE)

( * ) Notice: Subject to any disclaimer, the term of this patent is extended or adjusted under 35 U.S.C. 154(b) by 0 days.

(21) Appl. No.: 09/819,192

(22) Filed: Mar. 28, 2001

(65) Prior Publication Data

US 2002/0038798 A1 Apr. 4, 2002

(30) Foreign Application Priority Data

Mar. 31, 2000 (DE) ..... 100 16 067

(51) Int. Cl.[7] ..... H05B 1/00

(52) U.S. Cl. ..... 219/221; 219/521; 140/123.5; 140/123.6

(58) Field of Search ..... 219/221, 201, 219/521, 227, 228, 230, 233, 240, 538, 552, 469; 338/203; 140/123.5, 123.6, 139, 140; 29/33 F

(56) References Cited

U.S. PATENT DOCUMENTS

| | | | | | |
|---|---|---|---|---|---|
| 3,232,147 | A | * | 2/1966 | Kureth | 219/233 |
| 3,667,328 | A | * | 6/1972 | Stolshek | 219/230 |
| 3,732,395 | A | * | 5/1973 | David | 219/521 |
| 3,765,276 | A | * | 10/1973 | Pollitt | 219/221 |
| 4,268,739 | A | * | 5/1981 | Evans | 219/233 |
| 4,319,952 | A | * | 3/1982 | Schjeldahl | 219/221 |
| 4,540,873 | A | * | 9/1985 | Kester | 219/201 |
| 4,653,362 | A | * | 3/1987 | Gerber | 219/221 |
| 4,672,865 | A | * | 6/1987 | Nespor | 219/221 |
| 4,764,662 | A | * | 8/1988 | Andersen et al. | 219/521 |
| 4,940,074 | A | * | 7/1990 | Menard | 140/123.6 |
| 5,436,431 | A | * | 7/1995 | Tsuji et al. | 219/469 |

* cited by examiner

*Primary Examiner*—Teresa Walberg
*Assistant Examiner*—Fadi H. Dahbour
(74) *Attorney, Agent, or Firm*—Pearne & Gordon LLP

(57) ABSTRACT

A device for forming a pointed wire tip on the ends of wires is provided. The device has receiving elements for receiving a wire, and heating device. The device stretches the wire causing the wire to taper and break resulting in the formation of a pointed wire tip at the point of breakage.

20 Claims, 2 Drawing Sheets

DEVICE AND PROCEDURE OF FORMING A POINT ON WIRE ENDS

BACKGROUND OF THE INVENTION

The present invention relates to a device as well as a procedure for forming a point on the ends of wires.

Particularly when retracting wires in wire drawing machines, it is necessary to form a point on the ends of the wires to be retracted so that same can be threaded into the next respective die.

A device for forming points on wire tips is already known in which the ends of the wires to be pointed are cold-formed between two rollers. The surfaces of the rollers have slots with increasing groove depth so as to produce a rounded cross-section of a wire end progressing essentially pointed.

Forming wire tips with said known device is, however, costly and time-intensive. Moreover, pointed wire tips manufactured with such a device exhibit burrs which are often unwanted.

It is thus the task of the present invention to produce a device for forming points on the ends of wires which is economical to manufacture, enables fast and burr-free wire end tips, and which can be flexibly adapted to different wire diameters.

The task is solved by a device for the forming of points on the ends of wires in accordance with the present invention.

In accordance with the present invention, a device is in particular provided for the forming of points on the ends of wires which comprises a first and a second means for the receiving of a wire, as well as a heating device and a means for stretching the wire according to predetermined conditions.

The heating device is preferably configured as an electric resistance heater or electrical heating means. Especially preferred is the heating means comprising at least one first contact point as well as at least one second contact point, respectively at least one first pole and at least one second pole. Said poles are preferably connected to a transformer. By means of these poles, hereinafter referred to as contact points, each heating means comes into contact with one respective section of the wire to be pointed. Hereby, a voltage drop occurs between said contact points, meaning especially within said wire, so that a current flows through the conductive wire, thereby inducing a heating of the wire in the section between the contact points.

According to the present invention, the heating means may also be of a different configuration.

The wire is braced against the first as well as the second receiving means. Said first and/or second receiving means respectively preferably comprises a clamping means in which the wire is clamped. Said clamping means can be configured as clamping pliers or be disposed with a rotatable, wedge-shaped disc as well as an adjustable lever having a conical point, whereby said disc is particularly configured as a tractive disc. Said tractive disc can preferably be operated either manually, or by a drive means comprising a motor, or in some other way. The clamping means may also be of a different configuration.

The heating device is such designed and arranged that the wire becomes heated between the first and the second receiving means.

Preferably, said first electrical contact point of said electrical heating means, respectively resistance heater, is disposed on said first receiving means and said second electrical contact point of said electrical heating means, respectively resistance heater, is disposed on said second receiving means.

It is also preferred that said electrical contact points are not disposed on said first receiving means or said second receiving means, which preferably are provided with clamping means for clamping the wire, or that only one of said receiving means has an electrical contact point.

According to the present invention, a further means is provided which stretches the wire in the heated section according to predefined conditions, in particular doing so in a longitudinal direction to the wire axis.

Especially preferred is using the inventive device as follows: By means of the heating device, configured in particular as a resistance heater, a section of wire in an area between the first and the second receiving means is heated. To this purpose, it is especially provided that the poles, respectively electrical contact points of said resistance heater are arranged on said first receiving means as well as on said second receiving means. The wire is preferably heated long enough to reach incandescence. During this heating or after having been heated, a means is utilized to stretch the wire in the heated section.

The first and the second receiving means, respectively the first and the second contact point, are preferably arranged to be relatively movable with respect to one another.

Especially preferred is that the first receiving means, respectively the first electrical contact point, is fixedly arranged and the second receiving means, respectively the second electrical contact point, is arranged to be rotatable or axially displaceable. The second contact point is particularly preferably arranged on the second receiving means such that upon axial mobility, said receiving means likewise displaces axially and upon rotation, the second receiving means follows a circular path.

This stretching of the heated, respectively incandescent section, can in particular induce that the wire initially tapers and ultimately breaks off. This tapering, respectively breaking off, results in a pointed wire tip. The configuration of the pointed wire as well as the length of the pointed segment can be influenced in different ways. For example, by varying the distance between the electrical contact points or the voltage of the resistance heater, respectively the temperature which the heating means generates in the wire, or the length of heating time, in particular in conjunction with the magnitude and duration of the force generated in the wire, or in other ways.

Preferably, the first contact point is arranged on a clamping member of said clamping means of said first receiving means such that the electrical contact point is pressed against the wire when the clamping member stresses the wire.

It is preferred, in corresponding manner, that a second contact point is arranged on a second clamping member of said clamping means of said second receiving means.

The clamping member is preferably disposed with a threading in which it is led.

It is preferred that said first receiving means and/or said second receiving means is configured as a clamping means and in fact in such a way that wires of different diameters or wires having differing cross-sectional geometries may be clamped.

The device according to the present invention can be used for forming points on various types of wire materials such as, for example, superconductor, CrNi, German silver, or wires made from other types of material.

The inventive device can furthermore be used with wires having different cross-sectional profiles such as triangular, rectangular, polygonal, or rounded or other cross-sectional profile configurations.

The inventive device may be integrated in a wire drawing machine or may be a separate device which, for example, can be moved on rollers or by other similar means.

The inventive device can in particular be used to form points on wires which are drawn in rough drawing processor, whereby the wire diameter is preferably between a range of 2 mm–8 mm. The device according to the present invention is however also preferred for wires of other diameters.

The second receiving means, which is preferably disposed with a second electrical contact point, is movable relative the first receiving means via a drive means such as a motor or the like, or manually.

SUMMARY OF THE INVENTION

The present invention especially provides for heating a wire at a predetermined section and particularly in such a manner that it glows reddish and is subsequently stretched in at least the area of this section in the longitudinal direction of the wire axis such that the wire initially tapers and ultimately breaks off, forming a pointed tip at the end of the wire.

In a particularly preferred procedure of the present invention, the wire is heated by means of an electrical resistance heater.

In a preferred procedure of the present invention, the wire is clamped between two points separated by a clearance and is heated in the (or in one) intermediate region between said two points. The wire is then subsequently stretched, wherein one clamping point is moved relative the other clamping point. This induces the wire to taper and break off, forming a pointed wire tip.

The present invention is not to be limited by either its preferred embodiments nor by the examples as given.

In the following, the invention will be described in greater detail using exemplary, nonrestricting embodiments of the present invention, which show:

DETAILED DESCRIPTION OF THE INVENTION

Figure 1:
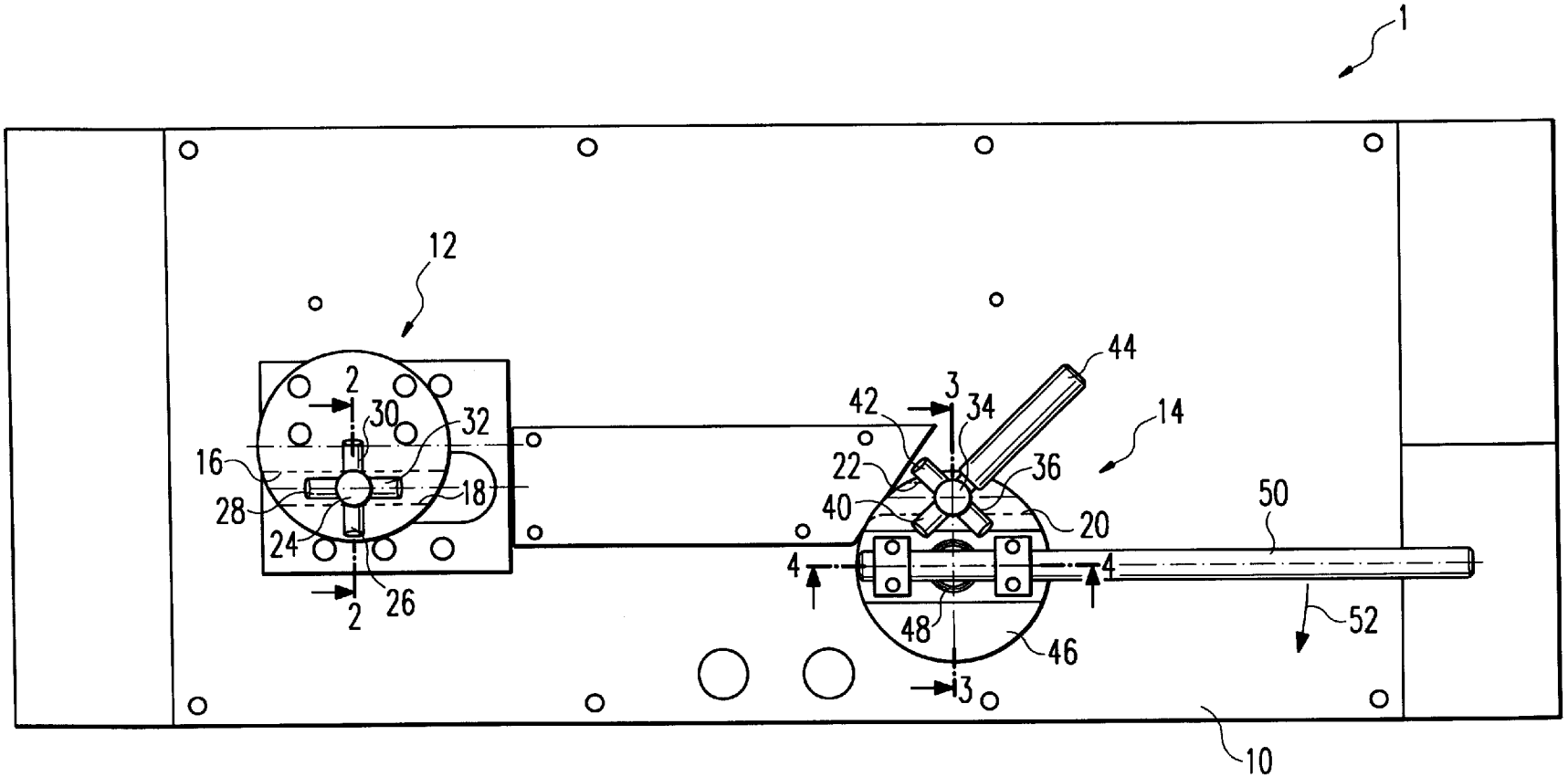
FIG. 1 a schematic view of an exemplary inventive embodiment.

FIG. 1 shows an inventive device 1 for forming a point on the ends of wires comprising a housing 10, a first receiving means 12 as well as a second receiving means 14. A wire to be pointed is received in the respective area suggested by dashed lines 16, 18, respectively 20, 22 of said first receiving means 12, respectively said second receiving means 14, and extends between said areas.

The first receiving means 12 comprises a first clamping member 24. Said first clamping member 24 is led (which is not shown in FIG. 1) into a threading and has radial cantilever arms 26, 28, 30, 32, which serve to facilitate operability.

The second receiving means 14 comprises a second clamping member 34, likewise led (not depicted in FIG. 1) into a threading and having radial cantilever arms 36, 40, 42, 44.

Said second receiving means furthermore comprises a disk-shaped support 46 which is rotatably mounted on a swivel joint 48.

Electrical contact points are respectively arranged on said clamping members 24, 34, said contact points being connected to a transformer. When an electrical voltage is applied to the contact points, the (not shown) wire is heated at a section between the first receiving means 12 and the second receiving means 14. During this heating or subsequent to this heating, lever 50 can turn in the rotational direction indicated by arrow 52, which induces a rotation of the disk-shaped support and thus a change in the distance of clamping member 34 from clamping member 24. When the wire reaches a suitable temperature, the rotational motion induces a stretching of the wire without a large application of force, whereby the wire profile tapers and breaks off, forming a pointed tip at the end of the wire.

Figure 2:
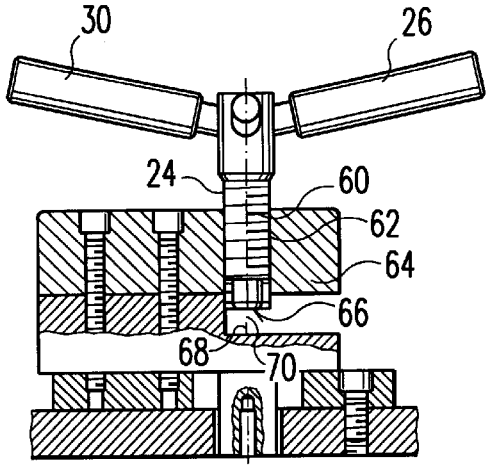
FIG. 2 a sectional view along the 2—2 line from FIG. 1.

FIG. 2 shows a sectional representation along the 2—2 line from FIG. 1 in revolved view.

Said first clamping member 24 is connected to component 64 by means of threading 60 as well as by means of counter-threading 62. A rotation of component 24 about its axis induces that, upon the corresponding rotational direction, facing end 66 of said first clamping member 24, functioning as a clamping jaw, is moved toward surface 68 functioning as a counter clamping jaw. Facing end 66 is furthermore an electrical contact point which is connected (not shown) to a transformer.

The wire to be pointed can be received, respectively clamped, in the intermediate region 70 between said facing end 66 and said surface 68.

Figure 3:
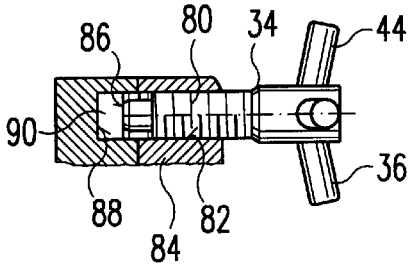
FIG. 3 a sectional view along the 3—3 line from FIG. 1.

FIG. 3 shows a sectional view along the 3—3 line from FIG. 1 in partial sectional view.

The second clamping member 34 comprises a threading 80 at its outer periphery, which extends into a threading 82 of component 84 so that upon the corresponding rotational direction, facing end 86 of said second clamping member 34, which also functions as a second electrical contact point, moves toward surface 88 so that the wire arranged in intermediate region 90 between said facing end 84 and said surface 86 can be clamped.

Figure 4:
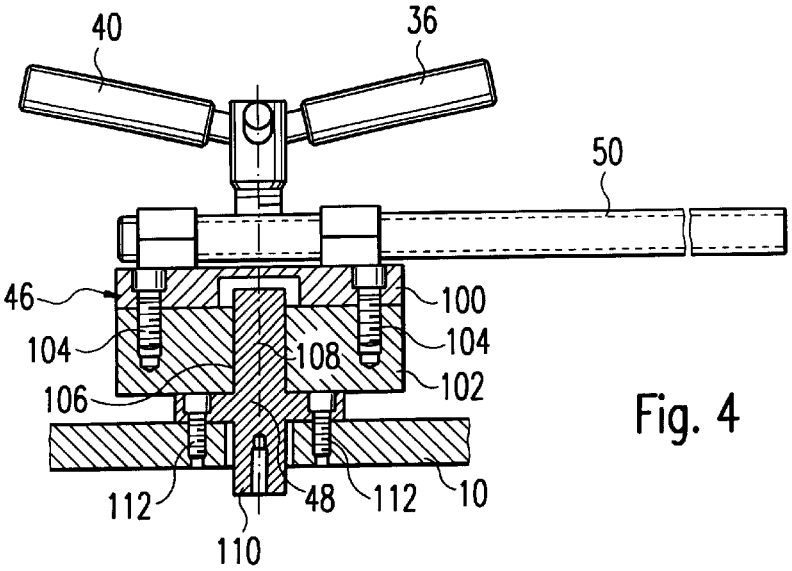
FIG. 4 a sectional view along the 4—4 line from FIG. 1.

FIG. 4 shows a sectional view along the 4—4 line from FIG. 1.

FIG. 4 depicts in particular the rotational mounting of disk-shaped support 46.

Said disk-shaped support comprises a first plate 100 as well as a second plate 102 which are non-rotatably coupled together by means of connecting elements such as screws 104.

Second plate 102 has a through opening 106 into which a cylindrical end 108 of component 110 extends. Component 110 is non-rotatably connected to housing 10 by means of the appropriate mounting, such as screws 112.

It is to be noted that other configurations for the rotatable mounting of support 46 are also preferred.

List of Reference Numerals

1 inventive device
10 housing
12 first receiving means
14 second receiving means
16 dashed line
18 dashed line
20 dashed line
22 dashed line
24 first clamping member
26 radial cantilever arm
28 radial cantilever arm
30 radial cantilever arm
32 radial cantilever arm
34 second clamping member
36 radial cantilever arm
38 radial cantilever arm
40 radial cantilever arm
42 radial cantilever arm
46 disk-shaped support
48 swivel joint
50 lever
52 arrow
60 threading
62 counter-threading
64 component
66 facing end
68 surface
70 intermediate region
80 threading
82 threading
84 component
86 facing end
88 surface
90 intermediate region
100 first plate
102 second plate
104 screw
106 opening
108 cylindrical end
110 component

What is claimed is:

1. Device for forming a pointed wire tip, characterized by a first means (12) for receiving the wire;

at least one second means (14) for receiving the wire;

at least one heating device which heats the wire in a section between said first receiving means (12) and said second receiving means (14); and at least one means which stretches the wire in the heated section according to pre-defined conditions in the direction of the longitudinal axis of the wire, wherein said stretching of the wire causes the wire to taper and break, thereby forming said pointed wire tip.

2. Device according to claim 1, characterized in that said heating device is configured as a resistance heater.

3. Device according to claim 1, characterized in that said heating device is configured as an electrical heating means and comprises at least one electrical contact point for contacting a first section of the wire as well as at least one second electrical contact point for contacting a second section of the wire, whereby an electrical voltage drop occurs between said electrical contact points.

4. Device according to claim 3, characterized in that said first electrical contact point is arranged on said first receiving means (12) and said second electrical contact point is arranged on said second receiving means (14).

5. Device according to claim 3, characterized in that said electrical contact points are arranged to be relatively movable with respect to one another so that the distance between said electrical contact points may be changed.

6. Device according to claim 1, characterized in that said first (12) and/or said second receiving means (14) is/are configured as clamping means in which the wire is clamped.

7. Device according to claim 1, characterized in that said second receiving means (14) comprises at least one component (46) which is arranged to be relatively movable with respect to said first receiving means(12).

8. Device according to claim 7, characterized in that said at least one component (46) of said second receiving means (14), which is arranged to be relatively movable with respect to said first receiving means (12), stretches the wire according to predetermined conditions so that a load acting between said first (12) and said second receiving means (14) is generated in the axial direction of the wire.

9. Device according to claim 8, wherein said first receiving means receives said wire in a frictional contact connection.

10. Device according to claim 1, characterized in that said second receiving means (14) comprises a rotatably arranged component (46) on which the wire is clamped.

11. Device according to claim 10, said rotatably arranged component (46) being a disk.

12. Device according to claim 3, characterized in that an electrical voltage drop acting between said electrical contact points induces a heating of the wire extending between said electrical contact points, and the stretching of the wire, which is generated by a relative movement of said first and second receiving means (12; 14), induces the wire to separate at a predetermined heated section.

13. Device according to claim 3, characterized in that said first electrical contact point is arranged on a clamping member (24) of said first receiving means (12) which contacts the wire to be pointed in the area of said first electrical contact point and/or said second electrical contact point is arranged on a clamping member (34) of said second receiving means (14) which contacts the wire to be pointed in the area of said second electrical contact point.

14. Device according to claim 1, characterized in that said first (12) and/or second receiving means (14) is configured so as to be adjustable for clamping wires of differing diameters.

15. Procedure for forming a pointed wire tip, characterized by the steps:

providing a first means for receiving a wire;

providing at least one second means for receiving the wire;

heating the wire in a section between said first receiving means and said second receiving means; and stretching the wire in the heated section according to pre-defined conditions in the direction of the longitudinal axis of the wire, wherein said stretching of the wire causes the wire to taper and break, thereby forming said pointed wire tip.

16. Procedure according to claim 15, characterized in that the wire is heated by means of an electric resistance heater.

17. Procedure according to claim 15, characterized in that said heated section is arranged between two electrical poles to effect heating of the wire in said heated section.

18. Procedure according to claim 15, characterized by the steps:

clamping the wire at a first clamping point and at a second clamping point situated at a distance from said first clamping point, said heated section being between said first and said second clamping points;

said stretching of the wire being between said first and said second clamping points so that the wire separates between said first and said second clamping points thereby forming said pointed wire tip.

19. Procedure according to claim 18, characterized in that said second clamping point moves relative to said first clamping point.

20. Procedure for retracting wires in wire drawing machines, characterized by producing a pointed wire tip including the steps of:

providing a first means for receiving a wire;

providing at least one second means for receiving the wire;

heating the wire in a section between said first receiving means and said second receiving means; and stretching the wire in the heated section according to pre-defined conditions in the direction of the longitudinal axis of the wire, wherein said stretching of the wire causes the wire to taper and break, thereby forming said pointed wire tip.

* * * * *

UNITED STATES PATENT AND TRADEMARK OFFICE

CERTIFICATE OF CORRECTION

PATENT NO. : 6,479,798 B2
DATED : November 12, 2002
INVENTOR(S) : Josef Leipold

It is certified that error appears in the above-identified patent and that said Letters Patent is hereby corrected as shown below:

Title page, Item [54] and Column 1, line 1,
Please delete "OF", and insert therefor -- FOR --.

Title page,
Item [73], Assignee, please delete "Masohinenfabrik", and insert therefor -- Maschinenfabrik --.

Signed and Sealed this

Fifteenth Day of April, 2003

JAMES E. ROGAN
*Director of the United States Patent and Trademark Office*